United States Patent [19]

Small et al.

[11] Patent Number: 4,844,266

[45] Date of Patent: Jul. 4, 1989

[54] DISPLAY SYSTEM

[75] Inventors: Jason W. Small, Los Angeles; Robert P. Colelli, Yorba Linda, both of Calif.

[73] Assignee: Intercraft Industries Corporation, Chicago, Ill.

[21] Appl. No.: 74,082

[22] Filed: Jul. 16, 1987

[51] Int. Cl.[4] ..... A47F 5/08

[52] U.S. Cl. ..... 211/88; 211/90; 211/94

[58] Field of Search ..... 211/88, 94, 90, 175, 211/162, 94.5, 193; 52/710

[56] References Cited

U.S. PATENT DOCUMENTS 3,191,776 5/1965 Tokash .
3,595,404 7/1971 Goldstein et al. .
3,986,649 10/1976 Heimstra ..... 211/88 X
4,008,807 2/1977 Phillips .
4,155,459 10/1977 Marschak .
4,510,872 4/1985 Parry ..... 211/50
4,552,272 11/1985 Field .
4,576,292 3/1986 Percival .
4,615,448 10/1986 Johnstonbaugh .
4,632,256 12/1986 Gambello .

*Primary Examiner*—Sarah A. Lechok
*Attorney, Agent, or Firm*—Emrich & Dithmar

[57] ABSTRACT

An adjustable display system includes a plurality of mounting brackets which include a mounting tongue receivable in horizontally extending slots of a slotted display board for detachably mounting the brackets on the display board, the mounting bracket arranged in pairs with each pair of mounting brackets defining a shallow, upwardly open forward compartment and a deeper upwardly open rearward compartment, the width of each compartment being determined by the spacing between the pair of mounting brackets.

21 Claims, 1 Drawing Sheet

DISPLAY SYSTEM

BACKGROUND OF THE INVENTION

This invention relates to display systems including apparatus for supporting merchandise or the like for display and storage, and more particularly, to an expandable and adjustable display system for merchandise or the like.

Various types of display apparatus have been developed in the past for displaying merchandise. The most prevalent display apparatus for article display uses peg boards and support components which are mounted on the peg boards to hold the articles to be displayed. One disadvantage of article display apparatus including peg boards is that adjustment of the relative spacing of the support components is limited because the spacings between the holes in the peg board are preset in both horizontal and vertical directions.

Accordingly, display arrangements have been developed which eliminate fixed spacings in the horizontal direction making the display apparatus adjustable and expandable. One such apparatus, disclosed in the U.S. Pat. No. 3,191,776 to S. G. Tokash, includes a display rack incorporating left-hand brackets and right-hand brackets, which cooperate in pairs for the display of articles of various sizes. Each pair of brackets includes mounting clips which depend from the bottom of each bracket and are applied to a pair of horizontally extending rods. The brackets are slidable along the rods to enable each pair of brackets to be spaced apart to accommodate whatever packaged merchandise is displayed therein.

Another display arrangement, disclosed in the U.S. Pat. No. 4,552,272 of Frank P. Field, incorporates a slotted display board having horizontally extending slots for mounting storage bins. Each bin has a left-hand wall, a right-hand wall and a bottom wall defining a single compartment within which merchandise may be displayed. At the top of the rear wall of the bin is a rearwardly offset tongue which fits into a selected one of the slots. A bin can be mounted at a selected location on the board by inserting the tongue into the appropriate portion of one slot and then letting the bin rest against the forward surface of the board.

SUMMARY OF THE INVENTION

It is an object of the present invention to provide an improved display system which is adjustable and expandable.

Another object of the invention is to provide a display system which is inexpensive to manufacture and which is easily and readily assembled.

Another object of the invention is to provide an improved mounting bracket for use with display boards of the type having horizontally extending mounting slots.

These and other objects are achieved by the present invention which provides a display apparatus for displaying a single article and storing a plurality of such articles, the display apparatus being adapted for use with a display board having a forward surface with a plurality of openings, the display apparatus comprising at least one pair of mounting brackets constructed and arranged for detachable mounting on the display board, each of the mounting brackets having a front wall, a rear wall, a side wall, a bottom wall, an intermediate wall and mounting means, the front and rear walls extending upwardly from the bottom wall near opposite ends thereof, the side wall extending along the left side of the bottom wall for one of the mounting brackets and along the right side of the bottom wall for the other one of the mounting brackets as viewed from the front wall to the rear wall of the mounting brackets, the intermediate wall extending upwardly from the bottom wall and being disposed between the front and rear walls and being located closer to the front wall than to the rear wall, the distance between the front wall and the intermediate wall being such as to accommodate only a single one of the articles, the distance between the intermediate wall and the rear wall being such as to accommodate a plurality of the articles, the mounting means including a mounting tongue for insertion into an opening in the display board, the mounting brackets being adapted to be mounted on the display board in spaced apart, side-by-side relationship the front and intermediate walls of the pair of mounting brackets defining one upwardly open display compartment shallow in depth from front to rear and having split article supporting surfaces defined by the portion of the bottom wall of the mounting brackets forward of the intermediate walls for displaying a single sample of an article, and the intermediate and rear walls of the pair of mounting brackets defining one upwardly open storage compartment of a greater depth from front to rear than the depth of said display compartment and having split article supporting surfaces defined by the portion of the bottom wall of the mounting brackets rearwardly of the intermediate walls for storing a plurality of the articles, the width of the display compartment and of the storage compartment being determined by the horizontal spacing between the pair of mounting brackets.

The invention consists of certain novel features and structural details hereinafter fully described, illustrated in the accompanying drawings, and particularly pointed in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF THE PREFERRED EMBODIMENT

Figure 1:
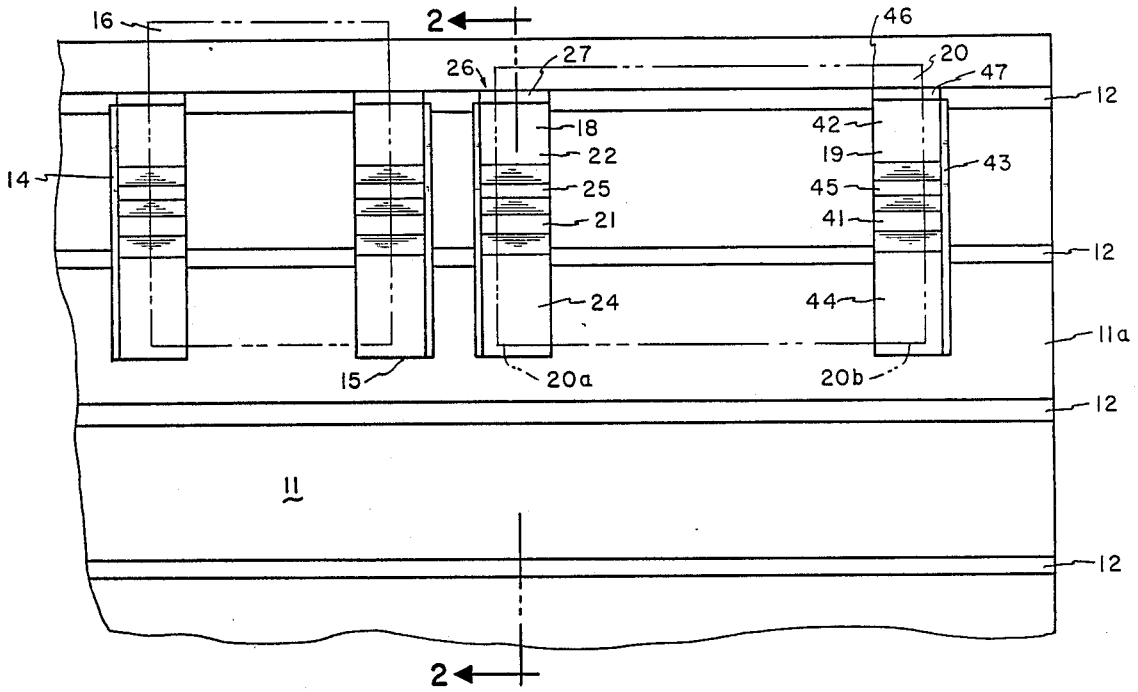
FIG. 1 is a fragmentary front elevational view of a display system including a display board and mounting brackets of the present invention.

Referring to FIG. 1, the display system 10 of the present invention includes a slotted display board 11 and a plurality of article mounting brackets, such as mounting brackets 14, 15, 18 and 19 shown in FIG. 1.

The article mounting brackets are detachably mounted on the display board 11 and are arranged in pairs to support an article, such as mounting brackets 14 and 15 which support an article 16, and brackets 18 and 19 which support an article 20. As will be shown, each pair of mounting brackets defines a relatively shallow upwardly open compartment at the forward portion of the brackets and a relatively deep upwardly open compartment at the rearward portion of the brackets.

The mounting brackets of the present invention can be used to support articles of various sizes and shapes, preferably articles generally rectangular in shape, with a pair of brackets supporting the article at opposite sides thereof. Thus, the mounting brackets 14 and 15 support article 16 at its lower left-hand and lower right-hand corners, respectively, as viewed in the direction from the front to the rear of the brackets. Thus, the mounting brackets 14 and 15 are hereinafter referred to as the left-hand mounting bracket and the right-hand mounting bracket, respectively.

Figure 2:
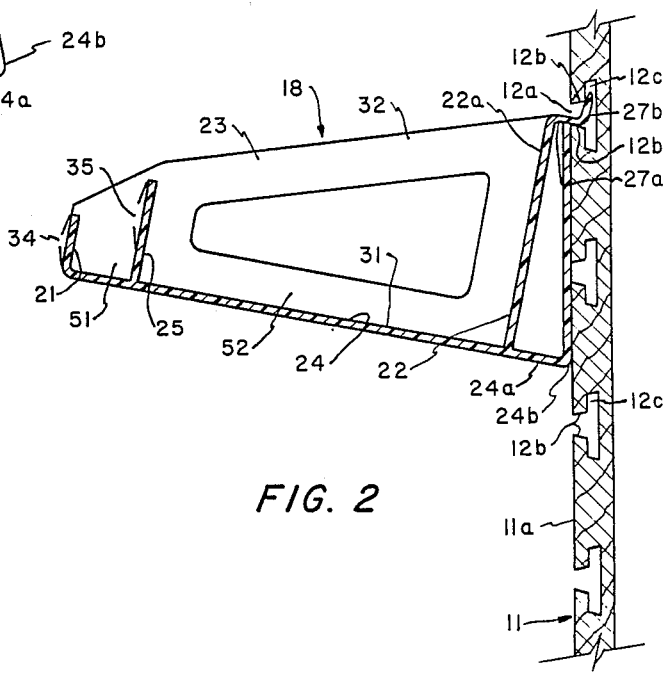
FIG. 2 is a sectional view taken along the line 2—2 of FIG. 1.

Referring to FIGS. 1 and 2, the display board 11 is formed of an integral layer of density fiber board nominally ¾" thick and may be attached directly to a wall or other vertical space or may be adapted for free-standing use. The display board 11 is provided with a plurality of spaced-parallel horizontally extending slots 12. Each slot has a modified T-shaped transverse cross-section as shown in FIG. 2 including a generally horizontally extending inlet portion **12*a*, with inwardly diverging sides or shoulders 12*b* and a verically extending portion 12*c* extending generally parallel to the longitudinal or vertical axis of the display board 11, and spaced rearwardly of the forward furface 11**a of the display board.

Figure 3:
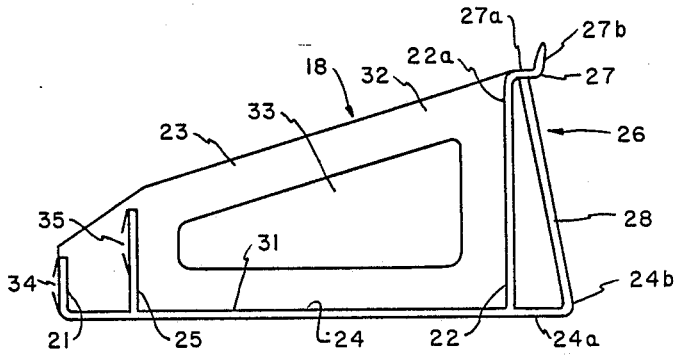
FIG. 3 is a side elevational view of a mounting bracket of the present invention.

Referring to FIGS. 2 and 3, each mounting bracket, such as left-hand mounting bracket 18 includes a front wall 21, a rear wall 22, a side wall 23, a bottom wall 24, an intermediate wall 25 and a support 26 including a mounting tongue 27 and spacer member 28. The mounting bracket 18 is made of a suitable rigid transparent plastic, preferably molded as a one-piece unit.

The front wall 21, rear wall 22 and intermediate wall 25 are flat rectangular members, the intermediate wall being slightly greater in vertical height than the front wall, and the rear wall being about twice the vertical height of the intermediate wall.

The front wall 21 and the rear wall 22 extend upwardly from the bottom wall 24 near opposite ends thereof. The intermediate wall 25 is located between the front and rear walls and extends upwardly therefrom. The front wall 21, the back wall 22 and the intermediate wall 25 extend generally parallel to one another and perpendicular to the bottom wall 24 which has a portion **24*a* which extends rearwardly behind rear wall 22**.

The side wall 23 is located at the left side of the bottom wall 24 and extends between the front wall 21 and rear wall 22. The side wall 23 is generally triangular in shape with its lower edge 31 extending horizontally and its upper edge 32 slanting downwardly from the back wall 22 to the front wall 21. The side wall is provided with an opening 33.

The mounting tongue 27 is an extension of the rear upper edge **22*a* of rear wall 22 and includes a horizontally extending portion 27*a*, which projects rearwardly from the rear upper edge 22*a* of rear wall 22, and a vertical portion 27*b* which extends upwardly in a generally vertical fashion from the distal end of portion 27*a*. The spacer member 28 is a flat elongated generally rectangular member extending from the rearward edge 24*b* of the bottom wall 24 upwardly and forwardly to the rear upper edge 22*a* of rear wall 22 at an angle of approximately 80° relative to the vertical rear wall 22. When the mounting bracket is mounted on the display board, the spacer member 28 engages the forward surface 11*a*** of the display panel, maintaining the mounting bracket tilted upward, oriented with its forward end raised above the horizontal end with the bottom wall inclined downwardly from front to rear of the mounting bracket.

The front wall 21 and intermediate wall 25 each define respective channels 34 and 35 for receiving cards (not shown) bearing indicia such as product identification information, product price information or product ordering information, or the like.

Referring to FIG. 1, the associated right-hand mounting bracket 19 includes a front wall 41, a rear wall 42, a side wall 43, a bottom wall 44, an intermediate wall 45 and a support 46 including a mounting tongue 47 and a spacer member (not shown). The mounting bracket 19 is a mirror image of the left-hand mounting bracket 18, having its side wall 43 located at the right-hand side of the bottom wall 44 and walls 41, 42 and 45, but otherwise identical in size and shape.

One mounting bracket which was constructed was made of a transparent plexiglass ⅛" thick. The mounting bracket was 10 inches in length measured along its bottom wall, 4 1/5 inches in vertical height measured along its rear wall, and having front and intermediate walls, respectively 1⅛ inches and 2 inches in vertical height. The width of the mounting bracket was 1½".

Figure 4:
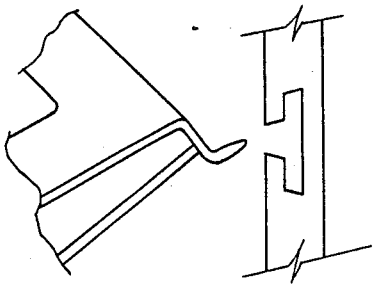
FIG. 4 is an enlarged fragmentary view of a portion of the display board and a portion of a mounting bracket illustrating the mounting of the bracket on the display board.

Referring to FIGS. 1, 2 and 4, to assemble a pair of mounting brackets, such as brackets 18 and 19, on the display board 11, each mounting bracket, such as mounting bracket 18, is oriented with its forward edge elevated relative to its rearward edge such that the vertical portion **27*b* of its mounting tongue 27 is aligned axially with the horizontal inlet portion 12*a* of the slot 12. The mounting bracket 18 is then moved toward the forward surface 11*a* of the display board to insert the vertical portion 27*b* of the mounting tongue 27 into the slot 12. When the vertical portion 27*b* of the mounting tongue 27 has been located fully within the slot, the mounting bracket 18 is rotated counterclockwise, moving the vertical portion 27*b* of the mounting tongue 27 into the upper vertical portion 12*c* of the slot 12 and moving the horizontal portion 27 into engagement with shoulder 12*b* at the lower forward edge of the inlet portion of the slot 12 until the spacer member 28 engages the forward surface 11*a* of the display board. Also, the spacer member 28 of the mounting bracket 18 extends along the forward surface 11*a* of the display board 11 in engagement therewith. The right-hand mounting bracket 19 of the pair is mounted in the same slot on the mounting board 11 in a similar manner to the right of mounting bracket 18. The paired brackets 18 and 19 are then adjusted as to their horizontal separation to define storage compartments fore and aft of the intermediate wall, of the width corresponding to that of the articles 20 to be contained therein. The mounting arrangement including support 26, with mounting tongue 27 in conjunction with slotted display board 11**, permits adjustment of the mounting brackets to receive articles of virtually any width and height.

As is apparent from FIG. 1, each two paired brackets, such as left-hand mounting bracket 18 and right-hand mounting bracket 19, when mounted on the display board 11 with their respective mounting tongues 27 and 47 located in the same horizontal slot, define a first upwardly open compartment 51 (FIG. 2) having split article supporting surfaces defined by the portion of bottom walls 24 and 44, forward of the intermediate walls 25 and 45, respectively. A second upwardly open compartment 52 (FIG. 2) having split article surfaces is defined by the portion of the bottom walls 24 and 44 rearward of the intermediate walls 25 and 45. As indicated above, the width of each compartment is established by adjusting the horizontal spacing between paired brackets such as brackets 18 and 19 along the mounting panel 11. The article of merchandise 20 is supported by the pair of brackets 18 and 19 with its left and right lower edges 20*a* and 20*b* resting upon the paired bottom walls 24 and 44. The shallow forward compartment 51 is used to display a single sample of the article of merchandise 20, and the deeper rearward compartment 52 is used to store a plurality of the articles. The spacer member 28 for mounting bracket 18 and spacer member 48 for mounting bracket 19, by engaging the forward surface of the display board, and by virtue of their angular extent relative to the bottom walls of the mounting brackets maintain the lower edge of rear walls 22 and 42 spaced forwardly of the forward surface 11*a* of the display board 11. Consequently, the mounting brackets 18 and 19 are oriented with their forward ends raised above the horizontal and with their bottom walls inclined downwardly from front to rear of the mounting brackets. In this way, the articles of merchandise supported within the rearward product storage compartment are tilted backwards toward the display board, making them more accessible to a customer.

We claim:

1. Display apparatus for displaying a single article and storing a plurality of such articles, said display apparatus being adapted for use with a display board having a forward surface with a plurality of openings therein, said display apparatus comprising at least one pair of mounting brackets constructed and arranged for detachable mounting on the display board, each of said mounting brackets having a front wall, a rear wall, a side wall, a bottom wall, an intermediate wall and mounting means, said front and rear walls extending upwardly from said bottom wall near opposite ends thereof, said side wall extending along the left side of said bottom wall for one of said mounting brackets and along the right side of said bottom wall for the other one of said mounting brackets as viewed from the front wall to the rear wall of said mounting brackets, said intermediate wall extending upwardly from said bottom wall and being disposed between said front and rear walls and being located substantially closer to said front wall than to said rear wall, the distance between said front wall and said intermediate wall being such as to accommodate only a single one of the articles, the distance between said intermediate wall and said rear wall being such as to accommodate a plurality of the articles, said mounting means including a mounting tongue for insertion into an opening in the display board, said mounting brackets being adapted to be mounted on the display board in spaced-apart, side-by-side relationship, the front and intermediate walls of the pair of mounting brackets defining one upwardly open display compartment shallow in depth from front to rear and having split article supporting surfaces defined by the portion of the bottom walls of said mounting brackets forward of said intermediate walls for displaying a single sample of an article, and the intermediate and rear walls of the pair of mounting brackets defining one upwardly open storage compartment of a greater depth from front to rear than the depth of said display compartment and having split article supporting surfaces defined by the portion of the bottom wall of said mounting brackets rearwardly of said intermediate walls for storing a plurality of the articles, the width of the display compartment and of the storage compartment being determined by the horizontal spacing between said pair of mounting brackets.

2. Display apparatus according to claim 1, wherein said mounting tongue corresponds in width to the width of said rear wall.

3. Display apparatus according to claim 1, wherein said mounting bracket and said mounting means thereon are of one-piece plastic construction.

4. Display apparatus according to claim 1, wherein said front and intermediate walls each include means defining on the forward surface thereof a channel for receiving an indicia bearing medium.

5. Display apparatus according to claim 1, wherein said intermediate wall is the only wall between said front and rear walls.

6. Display apparatus according to claim 1, wherein said mounting means includes no more than one mounting tongue.

7. Display apparatus according to claim 1, wherein said rear wall is substantially perpendicular to said bottom wall, said mounting means further including spacing means projecting beyond said rear wall rearwardly thereof and beneath said mounting tongue, said spacing means engaging the forward surface of the display board so as to maintain the lower edge of said rear wall spaced forwardly of the forward surface of the display board, whereby when mounted on the display board, said mounting brackets are oriented with their forward ends raised above the horizontal and their bottom walls inclined downwardly from front to rear of said mounting brackets, whereby the articles stored in said storage compartment are tilted backwards toward the display board.

8. Display apparatus according to claim 7, wherein said spacing means includes a planar member extending rearwardly at an angle relative to said rear wall from the top to the bottom thereof defining a planar surface which engages the forward surface of the display board when said mounting bracket is mounted thereon.

9. Display apparatus according to claim 1, wherein said front and rear walls extend generally parallel to one another.

10. Display apparatus according to claim 9, wherein said intermediate wall extends generally parallel to said front and rear walls.

11. Display apparatus according to claim 1, wherein said intermediate wall is fixed in position.

12. Display apparatus for displaying a single article and storing a plurality of such articles, said display apparatus being adapted for use with a display board having a forward surface with a plurality of slots therein in horizontal parallel spaced relationship and vertically spaced-apart, said display apparatus comprising at least one pair of mounting brackets constructed and arranged for detachable mounting on the display board, each of said mounting brackets having a front wall, a rear wall, a side wall, a bottom wall, an intermediate wall and mounting means, said front and rear walls extending upwardly from said bottom wall near opposite ends thereof, said side wall extending along the left side of said bottom wall for one of said mounting brackets and along the right side of said bottom wall for the other one of said mounting brackets as viewed from the front wall to the rear wall of said mounting brackets, said intermediate wall extending upwardly from said bottom wall and being disposed between said front and rear walls and being located substantially closer to said front wall than to said rear wall, the distance between said front wall and said intermediate wall being such as to accommodate only a single one of the articles, the distance between said intermediate wall and said rear wall being such as to accommodate a plurality of the articles, said mounting means including a mounting tongue for insertion into a slot in the display board, said mounting brackets being adapted to be mounted on the display board in spaced apart, side-by-side relationship with their respective mounting tongues located in the same horizontal slot in the display board, the front and intermediate walls of the pair of mounting brackets defining one upwardly open display compartment shallow in depth from front to rear and having split article supporting surfaces defined by the portion of the bottom wall of said mounting brackets forward of said intermediate walls for displaying a single sample of an article, and the intermediate and rear walls of the pair of mounting brackets defining one upwardly open storage compartment of a greater depth from front to rear than the depth of said display compartment and having split article supporting surfaces defined by the portion of the bottom wall of said mounting brackets rearwardly of said intermediate walls for storing a plurality of the articles, the width of the display compartment and of the storage compartment being determined by the horizontal spacing between said pair of mounting brackets.

13. Display apparatus according to claim 12, wherein said mounting tongue corresponds in width to the width of said rear wall.

14. Display apparatus according to claim 13 wherein said mounting bracket and said mounting means thereon are of one-piece plastic construction.

15. Display apparatus according to claim 12, wherein said front and intermediate walls each include means defining on the forward surface thereof a channel for receiving an indicia bearing medium.

16. Display apparatus according to claim 12, wherein said rear wall is substantially perpendicular to said bottom wall, said mounting means further including spacing means projecting beyond said rear wall rearwardly thereof and beneath said mounting tongue, said spacing means engaging the forward surface of the display board so as to maintain the lower edge of said rear wall spaced forwardly of the forward surface of the display board, whereby when mounted on the display board, said mounting brackets are oriented with their forward ends raised above the horizontal and their bottom walls inclined downwardly from front to rear of said mounting brackets, whereby the articles stored in said storage compartment are tilted backwards toward the display board.

17. Display apparatus according to claim 16, wherein said spacing means includes a planar member extending rearwardly at an angle relative to said rear wall from the top to the bottom thereof defining a planar surface which engages the forward surface of the display board when said mounting bracket is mounted thereon.

18. Display apparatus according to claim 12, wherein said front and rear walls extend generally parallel to one another.

19. Display apparatus according to claim 18, wherein said intermediate wall extends generally parallel to said front and rear walls.

20. Display apparatus according to claim 12, wherein said intermediate wall is the only wall between said front and rear walls.

21. Display apparatus according to claim 12, wherein said mounting means includes no more than one mounting tongue.

* * * * *